US006305652B1

(12) United States Patent
Borke et al.

(10) Patent No.: US 6,305,652 B1
(45) Date of Patent: Oct. 23, 2001

(54) LAPTOP COMPUTER SUPPORT

(76) Inventors: Chad Borke, 253 W. 76th St., #8, New York, NY (US) 10023; Eric R. Weigeshoff; Naomi Wielgos, both of 439 Bergen St., Apt. 3, Brooklyn, NY (US) 11217

( * ) Notice: Subject to any disclaimer, the term of this patent is extended or adjusted under 35 U.S.C. 154(b) by 0 days.

(21) Appl. No.: 09/286,748

(22) Filed: Apr. 6, 1999

(51) Int. Cl.[7] ..... A45D 19/04; A47J 47/16; F16M 4/00

(52) U.S. Cl. ..... 248/174; 248/459; 248/918

(58) Field of Search ..... 248/174, 176.1, 248/455, 460, 462, 451, 918, 459; 281/21.1; 206/320

(56) References Cited

U.S. PATENT DOCUMENTS

| | | | | |
|---|---|---|---|---|
| D. 359,179 | | 6/1995 | Cucinotta | D6/449 |
| D. 393,874 | * | 4/1998 | Hodes | D19/27 |
| 905,836 | | 12/1908 | Bowman | 312/233 |
| 2,471,003 | | 5/1949 | Monahan | 311/23 |
| 3,172,636 | | 3/1965 | Collier | 248/444 |
| 4,624,433 | | 11/1986 | Henneberg | 248/346 |
| 4,765,462 | * | 8/1988 | Rose, Jr. | 206/45.13 |
| 4,852,498 | | 8/1989 | Judd | 108/43 |
| 5,263,423 | | 11/1993 | Anderson | 108/43 |
| 5,337,985 | | 8/1994 | Hale | 248/174 |
| 5,445,266 | * | 8/1995 | Prete et al. | 206/320 |
| 5,503,361 | | 4/1996 | Kan-O et al. | 248/688 |
| 5,607,054 | * | 3/1997 | Hollingsworth | 206/320 |
| 5,611,098 | | 3/1997 | Skibik | 56/653 |
| 5,623,869 | | 4/1997 | Moss et al. | 108/43 |
| 5,713,548 | | 2/1998 | Boyer et al. | 248/205.2 |
| 5,732,910 | | 3/1998 | Martin | 248/118 |
| 5,762,250 | | 6/1998 | Carlton et al. | 224/579 |
| 5,775,497 | * | 7/1998 | Krulik | 206/320 |
| 5,887,777 | * | 3/1999 | Myles et al. | 224/578 |
| 5,971,148 | * | 10/1999 | Jackson | 206/320 |
| 6,030,140 | * | 2/2000 | Karten et al. | 402/73 |
| 6,213,439 | * | 4/2001 | Giulie et al. | 248/459 |

FOREIGN PATENT DOCUMENTS

| | | |
|---|---|---|
| 0555106A1 | 8/1993 | (EP) . |
| WO 98/34851 | 8/1998 | (WO) . |

* cited by examiner

*Primary Examiner*—Ramon O. Ramirez
*Assistant Examiner*—A. Joseph Wujciak
(74) *Attorney, Agent, or Firm*—Wood, Herron & Evans, L.L.P.

(57) ABSTRACT

A device for conveniently supporting a laptop computer on the lap of the user thereof, and more particularly to such a device which is substantially universally adjustable for supporting the computer in a preferred and optimal position for use. In its broadest aspects, the device is a portable, adjustable laptop (notebook) computer support. The device can also be used to support other portable data devices that have keyboards, such as pen-input-type computers and personal, electronic data organizers. The device is highly advantageous in that it provides for conveniently supporting a laptop computer on the lap of the user thereof in a preferred and optimal position for use even when the user is seated in any one of a wide variety of sub-optimal positions. The device is further advantageous in that it is lightweight, portable and substantially universally adjustable within a defined range of support surface angles. The device comprises three or more hinged panels which can be selectively folded and secured relative to one another in a preferred operational configuration.

28 Claims, 4 Drawing Sheets

LAPTOP COMPUTER SUPPORT

FIELD OF THE INVENTION

The present invention relates to a device for conveniently supporting a laptop computer on the lap of the user thereof, and more particularly to such a device which is substantially universally adjustable for supporting the computer in a preferred and optimal position for use.

BACKGROUND OF THE INVENTION

The use of laptop or notebook computers has proliferated in recent years to such a degree that it is more common than not to see their use on airplanes, in airports, at all types of meetings, and in a wide variety of public places, including libraries, restaurants, parks, etc. With such a wide array of circumstances of use, and the attendant variety of public and private seating, there is an equal number of physical conditions and positions in which the user may find himself or herself when using a laptop computer. Certainly not all of these conditions present the optimal situation for comfortable, ergonomically correct use of the laptop computer.

Of particular note is the problem presented in keeping the laptop computer keyboard at a comfortable height and angle relative to the wrists and hands of the user. This height and angle is typically dictated by the chair or seat in which the user is seated. If the chair or seat is relatively low, the user's knees may be higher than the lap, which will cause a laptop computer situated in the lap to be tilted forward or toward the user. This may present problems for proper use. Conversely, if the seat is relatively high, then the user's knees may be lower than the lap and the computer will be tilted away from the user. In either case, the problem is that the keyboard is not in a substantially horizontal position, which is highly desirable for most users.

As a means of addressing the above-described problem, many users will adjust their body position to achieve a substantially horizontal keyboard. This may be accomplished variously by slouching or by raising up on one's toes when the knees are too low, or by extending one's feet forward to lower the knees when they are too high. Both approaches deviate in a negative way from the ideal position of the feet being flat on the ground or floor and the knees being bent at a ninety degree angle. Such deviations can be uncomfortable, cause fatigue, and if maintained repeatedly and/or for long periods of time may cause injury. An additional problem many laptop computer users face is the tendency for the computer to shift or slide on the lap. Because of this tendency, the user frequently tenses the leg muscles to force them together and balance the computer. This may also cause discomfort and/or fatigue for the user. Moreover, resting the computer directly on the user's lap can have the further drawback of heating up the user's legs due to the fact that most laptop computers dissipate heat out through the bottom surface, causing still further discomfort.

Because it is not always possible to achieve the ideal lap, leg and knee positioning, and for the other reasons mentioned above, there has developed a need for a positioning aid for laptop computer users. In terms of currently available products or devices for laptop computer users, several examples will now be described. It is noted, however, that none of these devices satisfactorily addresses all the various problems mentioned above.

One product is the "Lapdog" (available from Sharper Image). This product is actually a laptop computer carrying case that includes two zippered saddlebags which unfold and drape across the user's legs to provide balance and stability. The computer rests on a high-traction rubberized surface which provides a thermal shield between the user and the laptop. Also, the bottom surface of the "Lapdog" is a textured material which is intended to prevent sliding relative to the user's legs. Clearly the "Lapdog" has no capability of being adjusted to compensate for variations in the sitting positions of users to ensure a horizontal keyboard.

Bowman U.S. Pat. No. 905,836, is directed to a lap desk which includes a top part, bottom part and back part which are hingedly connected. The three components may be folded as shown in FIGS. 1 and 3 of the Bowman patent to provide an inclined surface. However, the lap-desk work surface of the Bowman patent is limited to one of three distinct angles, and is not "universally adjustable."

Henneberg U.S. Pat. No. 4,624,433 discloses a tilt base for a CRT display terminal. While the tilt base disclosed in the Henneberg patent has several hingedly connected sections, the device is intended for desk or tabletop use and is not a portable independent device.

Kan-O U.S. Pat. No. 5,503,361 discloses an adjustable stand for mounting a notebook-type personal computer or a pen-input-type personal computer. Again, upon review of the features described in the Kan-O patent, it is clear that the device is not for use on a person's lap, but rather is intended for desk top or tabletop use. Furthermore, it does not appear that the angle of incline of the stand in Kan-O is universally adjustable, but rather may be limited to only two positions.

What is needed is a substantially universally adjustable, portable device for conveniently supporting a laptop computer on the lap of the user thereof to support the computer in a preferred, optimal position for use.

SUMMARY OF THE INVENTION

In its broadest aspects, the present invention is directed to a portable, adjustable laptop (notebook) computer support. The invention can also be used to support other portable data devices that have keyboards, such as pen-input-type computers and personal, electronic data organizers. For convenience in the ensuing description, general reference will be made to a laptop computer support. The invention is highly advantageous in that it provides for conveniently supporting a laptop computer on the lap of the user thereof in a preferred and optimal position for use even when the user is seated in any one of a wide variety of sub-optimal positions. The device is further advantageous in that it is lightweight, portable and substantially universally adjustable within a defined range of support surface angles.

One embodiment of the laptop computer support of the present invention includes a first panel, a second panel, and a third panel. The first panel includes a free edge and a hinged edge opposite the free edge. This hinged edge is hingedly connected to a first hinged edge of the second panel. The second panel further includes a second hinged edge opposite the first hinged edge. This second hinged edge is itself hingedly connected to a hinged edge on the third panel, with the third-panel hinged edge being positioned opposite a third-panel free edge.

This embodiment further includes a releasable and adjustable fastener combination, which advantageously may consist of a first fastener member on at least a portion of the first panel and a second fastener member on at least a portion of the third panel, with the first and second fastener members being oriented on their respective panels so that they may be releasably and adjustably fastened together. In this manner, the device provides multiple support surfaces and support-surface angles for a laptop computer or other suitable item. For example, when viewed in cross-section, the laptop computer support has a generally triangular shape, with the first panel having an outer support surface, and the third panel having an outer support surface, either of which may be used to support a computer or other object, with the other outer support surface typically resting on the lap of a user, on a table, or on another support surface which is separate from the laptop support device itself.

Because the fastener combination is both releasable and adjustable, the relative slope of the first panel and/or third panel may be adjusted over a wide range, thereby providing an optimal angle of support for a computer or other product. For example, if a user chooses to employ the device in conjunction with a lap-top computer, the user may adjust the first and second fastener members so as to provide an optimal slope or angle to the particular surface which is supporting the laptop computer, regardless of whether or not the support device is placed directly on the user's lap or on some other external support surface, such as a table or the tray-table on an airplane, etc.

In another embodiment of the laptop computer support of the present invention, the third panel includes not only a (first) hinged edge hingedly connected to the second hinged edge of the second panel, but also an oppositely-disposed second hinged edge. This second hinged edge of the third panel is hingedly connected to a hinged edge of a fourth panel, with the fourth panel having a free edge opposite the fourth-panel hinged edge. In this particular embodiment, the releasable and adjustable fastener combination may be positioned between the fourth panel and the first panel. As noted above, if desired, the fastener combination may include a first fastener member on the first panel and a second, cooperating fastener member on the fourth panel.

With reference to either embodiment described above, the first, second, third, and fourth panels of the laptop computer support may be made of any of a number of suitable materials. For example, depending upon the weight of the computer or other product to be supported, the panels advantageously may be a vacuum formed structure, such as polystyrene, or it may be injection molded and formed of polypropylene. If polypropylene is used, it may be molded into a shell for each of the panels and a separate insert forming the exposed panel surfaces may be used, such as a foam rubber, preferably with a non-skid surface. Similarly, with regard to the hinged connections, these connections may be formed in any suitable fashion using any suitable material. For example, if desired, any of the hinged connections may be formed using: a binder tape; a "living hinge" (typically made of a flexible plastic material); and/or separate, molded hinges, which may be attached to or molded into the panels in order to form a hinged connection. If the support device is injection molded, then it is contemplated that the hinges would be integrally molded and may simply be sections or webs of lesser thickness than the panels and, as such, would function as living-type hinges. The adjacent panel can be folded relative to one another at the location of the hinges (webs).

The releasable and adjustable fastener combination of the laptop computer support may be formed of any suitable material. One particularly advantageous material is Velcro® because of its durability, adjustability, and ability to maintain a particular position.

In addition, if desired, one or more of the outer support surfaces (of the first and third panels) may be provided with one or more raised surface projections. Depending upon the design of the particular projection or projections, the particular outer support surface incorporating the projection or projections may provide enhanced ventilation between the particular outer support surface and the computer or other product being supported by the support device. In one particular embodiment of the invention, the outer support surface of the first panel includes a series of surface projections, with the projections oriented in a series of parallel lines running diagonal relative to the generally rectangular shape of the first panel. Moreover, each of these linear projections includes a series of short, substantially perpendicular bisecting projections, which may be thicker than, but the same height as, the linear projections. And, while any pattern may be used, this pattern has been found to be beneficial in elevating a computer or other product slightly above the outer support surface, and increasing air flow and ventilation between the computer and support surface. If utilized in any particular embodiment of the invention, the projection or projections may be of any suitable height. A height of 3/32 inch has been found to be particularly suitable. As an alternative to projections, the first and third panels may have a series of through-holes to provide ventilation.

Each of the component parts of the device of the present invention may be of any size which is suitable for the particular object to be supported. For example, if the support device is used to support a laptop computer, then the device advantageously is sized so as to provide an adequate support surface for the laptop computer. Moreover, if the support device is going to be used directly on the lap of the user, the device should be sized so as to provide an adequate resting surface for both the computer and the lap of the user. By way of example, in the embodiment of the invention which includes a fourth panel, the first, second, third, and fourth panels may have a width of about 12.75 inches. In addition, the first panel may have a length of about 10.5 inches, the second panel may have a height of about 1.5 inches, the third panel may have a length of about 9 inches, and the fourth panel may have a length of about 1.5 inches. These dimensions have been found to be beneficial because they accommodate a conventional laptop computer, and provide excellent support on the lap of a typical user. In addition, a device having these dimensions may be stowed easily in a laptop-computer carrying bag.

These and other objects of the present invention will become apparent to persons skilled in the art upon review of the detailed description of the invention in conjunction with the drawings.

Detailed Description of the Invention

The invention will now be described in its several contemplated embodiments with reference to the drawings.

Figure 1:
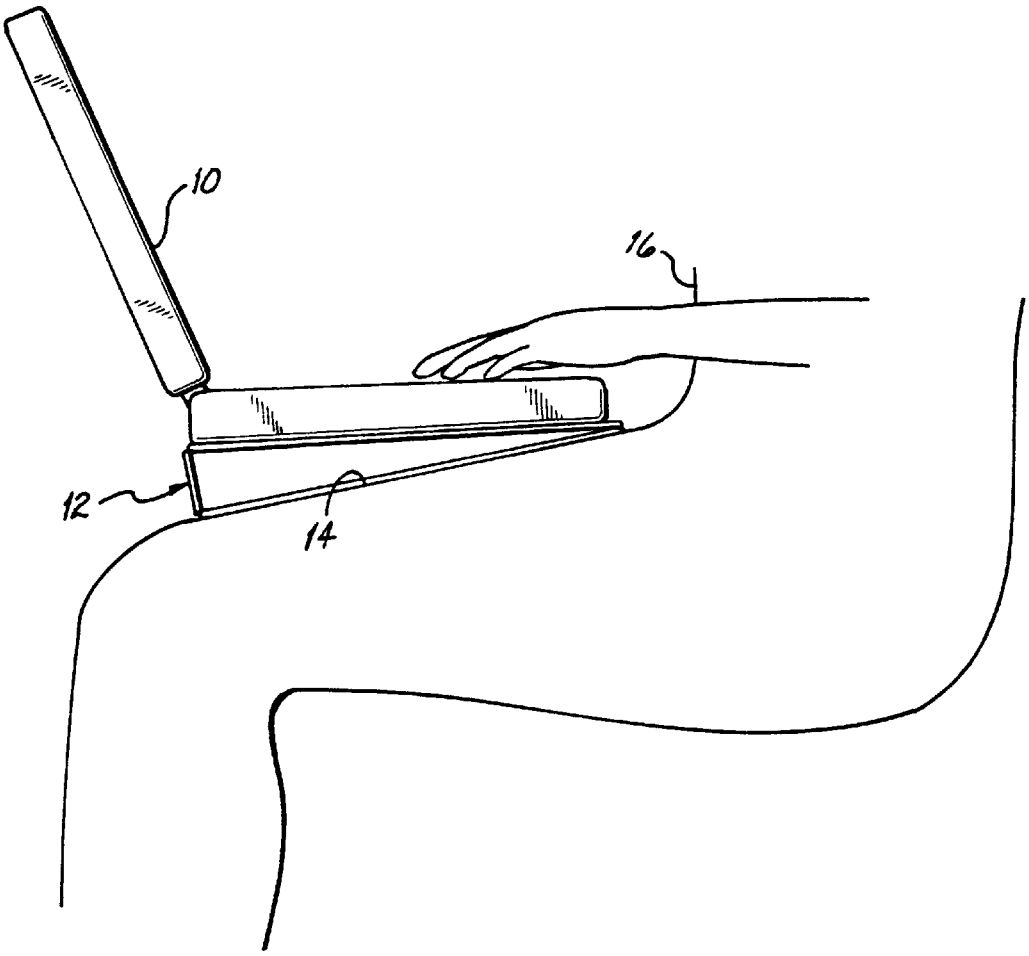
FIG. 1 is a partial side elevation of a laptop computer user utilizing one embodiment of the present invention.

FIG. 1 shows a laptop computer 10 supported on a laptop computer support device 12 of the present invention, and that combination is resting on the lap 14 of a computer user 16. As can be seen generally with reference to FIG. 1, support device 12 accommodates a downwardly tilted lap 14 such that the keyboard of the laptop computer is substantially horizontal and thus is in a preferred position for the user 16.

Figure 2:
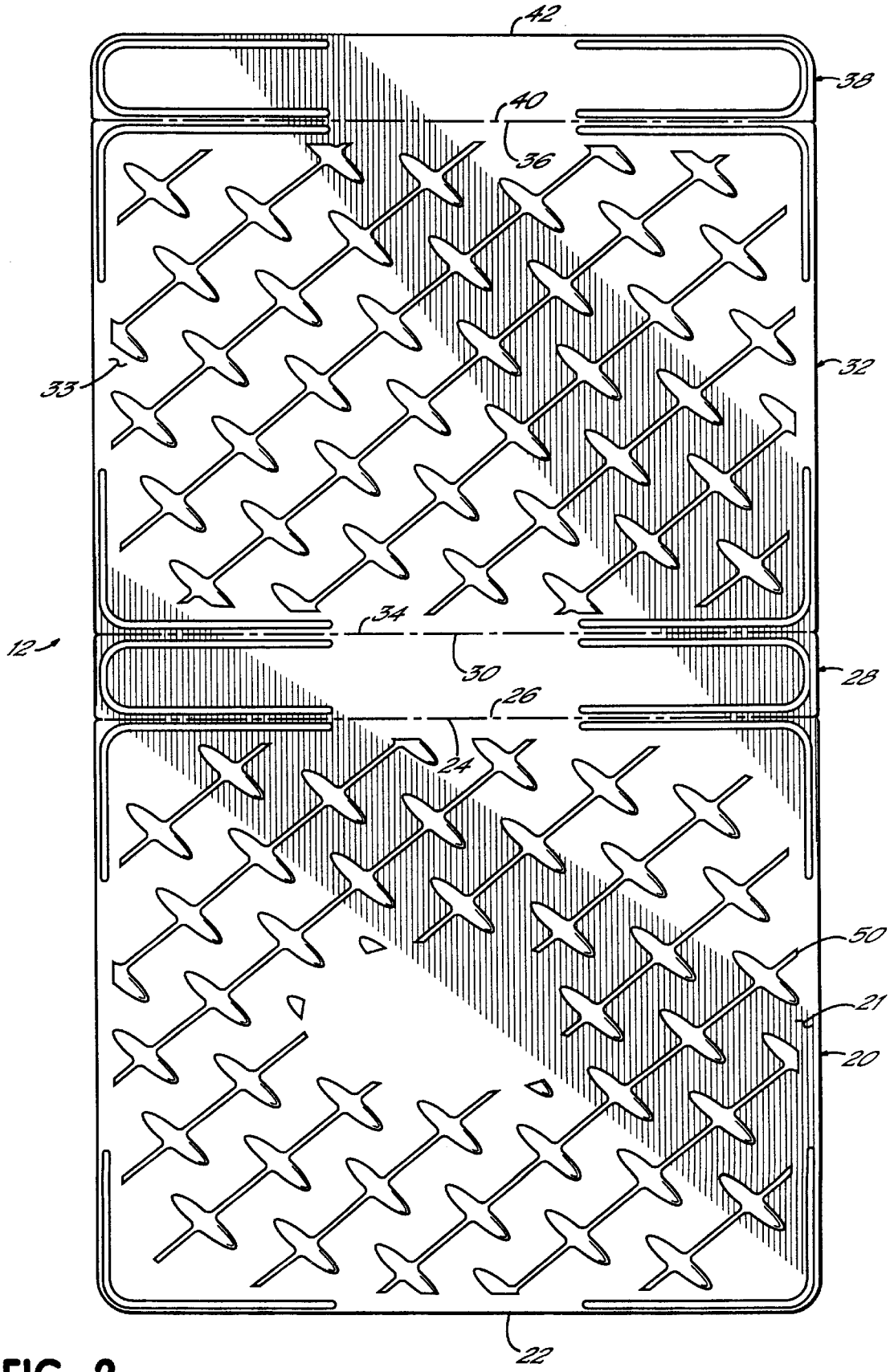
FIG. 2 is a top plan view of one embodiment of the present invention in a full unfolded position.

FIG. 2 shows one contemplated embodiment of the present invention in a fully unfolded, non-operational position. As shown, computer support device 12 has a first panel 20 with a free edge 22 and a hinged edge 24 opposite free edge 22. Hinged edge 24 is hingedly connected to a first hinged edge 26 of second panel 28. Second panel 28 further includes a second hinged edge 30 opposite first hinged edge 26 which is itself hingedly connected to third panel 32 at first hinged edge 34 thereof. Third panel 32 also has a second hinged edge 36 opposite first hinged edge 34 thereof. The second hinged edge 36 of third panel 32 is hingedly connected to fourth panel 38 at hinged edge 40 thereof. Fourth panel 38 also includes a free edge 42 opposite hinged edge 40.

With reference to FIGS. 3–8, the support device 12 of the present invention is shown in a variety of operational positions. Each of FIGS. 3–8 (with the exception of FIG. 5B) depicts the four-panel embodiment shown in FIG. 2. FIG. 5B shows an alternative three-panel embodiment. In both embodiments, support device 12 includes a releasable and adjustable fastener combination which preferably consists of a first fastener member 44 located on at least a portion of the first panel 20 and preferably generally near the free edge 22 thereof. In the three-panel embodiment shown in FIG. 5B, the adjustable fastener combination further includes a second fastener member 46 located on at least a portion of third panel 32 preferably at or adjacent edge 36 thereof. In the four-panel embodiment shown in FIGS. 3–5A and 6–8, the second fastener member 46 is located on fourth panel 38. The elements of adjustable fastener combination 44, 46 are advantageously positioned such that, as shown in FIG. 5A for example, when third panel 32 and first panel 20 are brought into engagement, the fastener combination adjustably retains the position and orientation of those panels. This is depicted with respect to the four-panel embodiment shown variously in FIGS. 5A, 6 and 7.

As can be seen with reference to FIGS. 5A–7, the angle of device 12 is adjustable by virtue of releasing and re-fastening the adjustable fastener combination 44, 46 to the desired location. While it is preferred to use corresponding hook and loop fastener material for the fastener combination 44, 46, other suitably releasable and adjustable fastener mechanisms can be utilized. If hook and loop strips are utilized for the adjustable fastener combination 44, 46, that material is advantageously adhered to the respective panel members with a suitable adhesive backing, and may comprise continuous strips or one or more segments.

Figure 3:
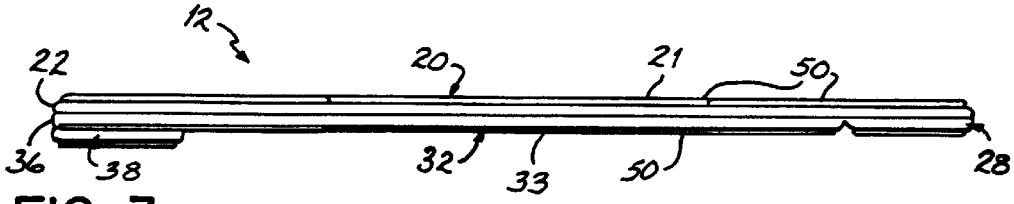
FIG. 3 is a side elevation of the embodiment of FIG. 2 in a fully folded position.
Figure 4:
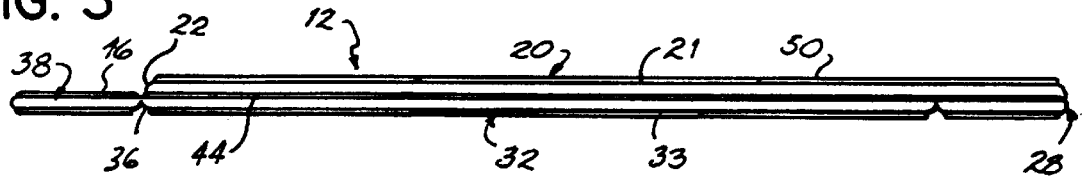
FIG. 4 is a side elevation of the embodiment of FIG. 2 in a ready position.
Figure 5A:
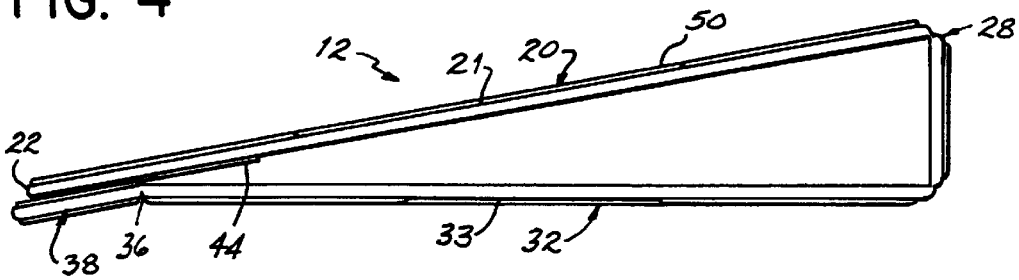
FIG. 5A is a side elevation of the embodiment of FIG. 2 in its tallest operational position.
Figure 5B:
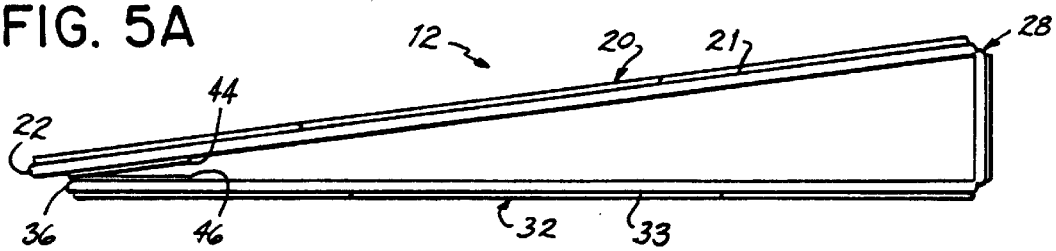
FIG. 5B is a side elevation of an alternative embodiment of the present invention in its tallest operational position.
Figure 6:
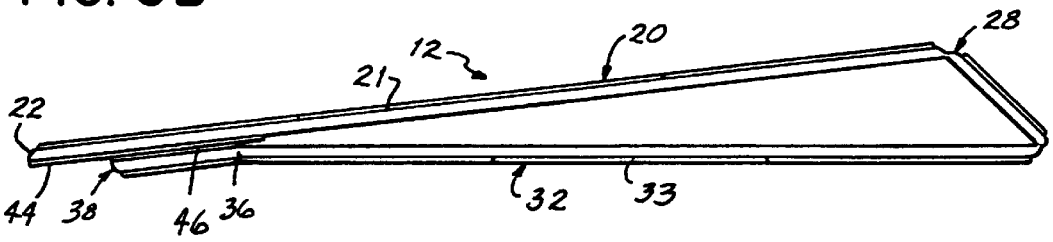
FIG. 6 is a side elevation of the embodiment of FIG. 2 in an alternative operational position.
Figure 7:
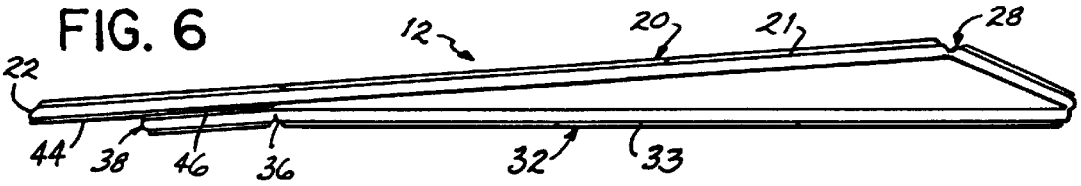
FIG. 7 is a side elevation of the embodiment of FIG. 2 in another alternative operational position.
Figure 8:
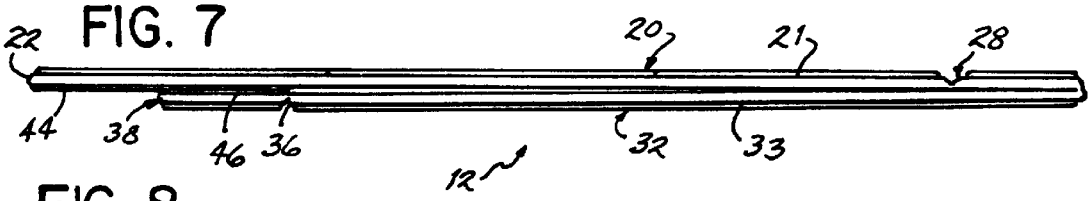
FIG. 8 is a side elevation of the embodiment of FIG. 2 in a flat operational position.

FIG. 8 shows the support device 12 in yet another contemplated configuration which is substantially flat. In this orientation, panels 20 and 28 are substantially parallel to panels 32 and 38. The fastener combination 44, 46 will retain the device in this orientation. Such an orientation is contemplated for providing support of the laptop computer and as an aid to prevent it from sliding off the lap of the user. Furthermore, the device will insulate the lap of the user from the heat generated by the computer itself The orientation shown in FIG. 8 is also one potential orientation for the portability of the device in that when folded flat in this orientation it is easily stored in a laptop computer carrying case. FIGS. 3 and 4 show alternative flat configurations.

Again with reference to FIG. 2, there is shown a top, unfolded view of the support device. As can be seen, the upper support surface 21 of first panel 20 may include upraised projections or ribs 50 in a defined pattern. Such ribs 50 are for the purpose of raising the computer slightly off of the support surface to increase the ventilation for the computer. Such projections may have any suitable height but a height on the order of 3/32" of an inch has been found to be suitable. These projections may also provide a non-skid surface such that the computer is less apt to slide around and potentially fall off of the support device and lap of the user. Likewise, the underside of third panel 32 has a surface 33 which contacts the lap of the user. Advantageously surface 33 may also include either a non-skid material to further aid in preventing sliding and shifting of the support device 12 and computer on the lap of the user, or more preferably, the same type of ribs 50 found on surface 21. This may be particularly helpful for computer users on airplanes or riding in another mode of transportation where there may tend to be jostling or movement. It is important to prevent the dropping of the laptop computer as that is a very significant cause of the catastrophic failure of such computers. Also, by having the ribs 50 on both surfaces, the device 12 can be flipped over and used in that orientation.

With respect to the hinge construction used in hingedly connecting the various panels of the devices described herein, living hinges, which are well known in the art, are preferred. In fact living hinges can be molded into the device at the time of fabrication. Furthermore, a relatively heavy duty binder tape could be used to hingedly adhere adjacent panels which themselves are typically of foam construction. Also, any manner of molded hinge construction would be suitable.

Figure 9:
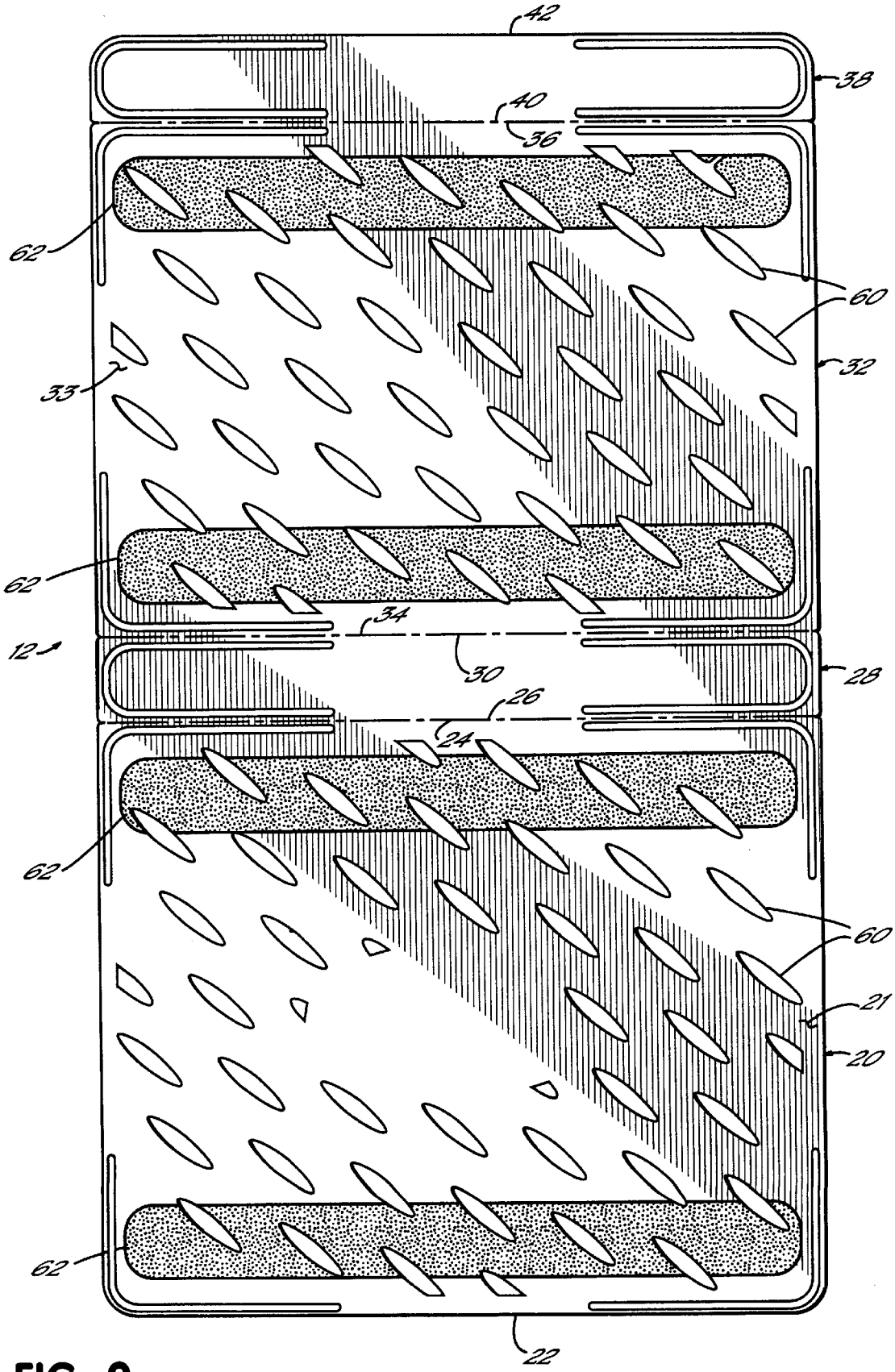
FIG. 9 is a top plan view of an alternative embodiment of the present invention in a fall unfolded position.

FIG. 9 is an alternative embodiment of the present invention in a fully unfolded position. This embodiment is in all respects the same as that shown and described with respect to FIG. 2, with the exception that there are no upraised projections 50 in the FIG. 9 embodiment, but rather there are a series of through-holes 60 in the first and third panels 20 and 32. In addition, if the surfaces 21 and 33 of panels 20 and 32 are not already of a non-skid material, then non-skid sections 62 can be utilized. For example, relatively thin rubber sheets 62 can be adhered to surfaces 21 and 33 at the noted locations to provide a non-skid effect.

It is to be understood that various changes and modifications may be made to the preferred embodiments discussed above without departing from the scope of the present invention, which is defined by the following claims and equivalents thereof.

What is claimed is:

1. A portable computer support device, comprising:

a first panel having at least one surface adapted to support an electronic device, said first panel having a free edge and a hinged edge opposite said free edge;

a second panel having a first hinged edge hingedly connected to said hinged edge of said first panel, said second panel also having a second hinged edge opposite said first hinged edge;

a third panel substantially the size of the first panel, said third panel having at least one surface adapted to contact the lap of a user of the support device, said third panel having a hinged edge hingedly connected to said second hinged edge of said second panel, said third panel also having a free edge opposite said hinged edge; and an adjustable fastener combination associated with said first and third panels such that the height of the first panel may be adjusted.

2. The portable computer support device of claim 1 wherein said adjustable fastener combination comprises a first fastener element associated with one of said first and third panels, and a second fastener element associated with the other of said first and third panels, such that when said first and third panels are brought into engagement with one another said adjustable fastener combination fastener retains said first and third panels in engagement.

3. The portable computer support device of claim 2 wherein said first and second fastener elements are hook and loop material, respectively.

4. The portable computer support device of claim 1 wherein said adjustable fastener combination facilitates releasably securing said portable computer support device in a selected operational configuration.

5. The portable computer support device of claim 1 wherein said panels are injection molded.

6. The portable computer support device of claim 5 wherein said injection molded panels are made of polypropylene.

7. The portable computer support device of claim 1 wherein said panels are vacuum formed.

8. The portable computer support device of claim 7 wherein said vacuum formed panels are made of polystyrene.

9. The portable computer support device of claim 1 wherein said support surface of said first panel has a plurality of upraised projections thereon.

10. The portable computer support device of claim 1 wherein said support surface of said first panel has a plurality of ventilation through-holes.

11. The portable computer support device of claim 1 wherein said lap contact surface of said third panel has at least a section of non-skid surface material.

12. The portable computer support device of claim 10 wherein said support surface of said first panel has at least a section of non-skid surface material.

13. The portable computer support device of claim 1 wherein said lap contact surface of said third panel has a plurality of upraised projections thereon.

14. The portable computer support device of claim 1 wherein said lap contact surface of said third panel has a plurality of ventilation through-holes.

15. A portable computer support device, comprising:

a first panel having at least one surface adapted to support an electronic device, said first panel having a free edge and a hinged edge opposite said free edge;

a second panel having a first hinged edge hingedly connected to said hinged edge of said first panel, said second panel also having a second hinged edge opposite said first hinged edge;

a third panel having at least one surface adapted to contact the lap of a user of the support device, said third panel having a first hinged edge hingedly connected to said second hinged edge of said second panel, said third panel also having a second hinged edge opposite said first hinged edge;

a fourth panel having a hinged edge hingedly connected to said second hinged edge of said third panel, said fourth panel also having a free edge opposite said hinged edge; and an adjustable fastener combination associated with said first and fourth panels such that the height of the first panel may be adjusted.

16. The portable computer support device of claim 15 wherein said adjustable fastener combination comprises a first fastener element associated with one of said first and fourth panels, and a second fastener element associated with the other of said first and fourth panels, such that when said first and fourth panels are brought into engagement with one another said adjustable fastener combination fastener retains said first and fourth panels in engagement.

17. The portable computer support device of claim 16 wherein said first and second fastener elements are hook and loop material, respectively.

18. The portable computer support device of claim 15 wherein said adjustable fastener combination facilitates releasably securing said portable computer support device in a selected operational configuration.

19. The portable computer support device of claim 15 wherein said panels are injection molded.

20. The portable computer support device of claim 19 wherein said injection molded panels are made of polypropylene.

21. The portable computer support device of claim 15 wherein said panels are vacuum formed.

22. The portable computer support device of claim 21 wherein said vacuum formed panels are made of polystyrene.

23. The portable computer support device of claim 15 wherein said support surface of said first panel has a plurality of upraised projections thereon.

24. The portable computer support device of claim 15 wherein said support surface of said first panel has a plurality of ventilation through-holes.

25. The portable computer support device of claim 15 wherein said lap contact surface of said third panel has at least a section of non-skid surface material.

26. The portable computer support device of claim 15 wherein said support surface of said first panel has at least a section of non-skid surface material.

27. The portable computer support device of claim 15 wherein said lap contact surface of said third panel has a plurality of upraised projections thereon.

28. The portable computer support device of claim 15 wherein said lap contact surface of said third panel has a plurality of ventilation through-holes.

* * * * *